United States Patent [19]

Nakamura

[11] Patent Number: 4,462,789

[45] Date of Patent: Jul. 31, 1984

[54] HEATING APPARATUS WITH DECORATIVE LIGHT EFFECT

[75] Inventor: Kazuharu Nakamura, Nagoya, Japan

[73] Assignee: Toyotomi Kogyo Co., Ltd., Aichi, Japan

[21] Appl. No.: 324,869

[22] Filed: Nov. 25, 1981

[51] Int. Cl.[3] ..... F21V 7/22

[52] U.S. Cl. ..... 431/126; 126/92 B; 431/344; 272/8 D; 272/8 M; 362/163; 362/182; 362/806; 40/427

[58] Field of Search ..... 126/92 B; 350/291; D26/132; 362/163, 166, 180, 351, 355, 356; 431/126; 272/8 D, 8 M, 13; 40/427, 428, 444, 541, 542

[56] References Cited

U.S. PATENT DOCUMENTS

| | | | |
|---|---|---|---|
| D. 26,350 | 12/1896 | Blair | D26/132 |
| D. 104,524 | 5/1937 | Bottome | D26/132 |
| 462,954 | 11/1891 | Myers | 126/97 |
| 2,564,708 | 8/1951 | Mochel | 126/92 B |
| 3,209,192 | 9/1965 | Decker | 350/291 |
| 3,934,572 | 1/1976 | Teague, Jr. | 431/215 |
| 3,937,948 | 2/1976 | Allison | 350/291 |
| 4,001,576 | 1/1977 | Goddard | 350/291 |

OTHER PUBLICATIONS

*The Fundamentals of Physics,* Halliday & Resnick Revised Printing ©1974 Wiley & Sons, pp. 715–718, esp. 717–718.

*Primary Examiner*—Larry Jones
*Assistant Examiner*—A. Flanigan
*Attorney, Agent, or Firm*—Koda and Androlia

[57] ABSTRACT

The burning cylinder for use in heating apparatuses consists of a base which is disposed to surround a heat source such as flame or red-hot material, constitutes the shell of a burning chamber and is made of a material that is high in heat-resistivity and transparent or translucent such as glass or the like and at least has its inside deposited with a coating layer of metal, e.g., Ti, Zr, Fe, etc. or a coating layer of a compound of such metals.

6 Claims, 5 Drawing Figures

HEATING APPARATUS WITH DECORATIVE LIGHT EFFECT

BACKGROUND OF THE INVENTION

The present invention relates to a burning cylinder for use in heating apparatuses utilizing flame which is accompanied by generation of heat and luminescence, e.g., oil stove and gas stove, or heating apparatuses utilizing a red-hot material which is accompanied by generation of heat and luminescence, e.g., electric stove.

Heretofore, as burning cylinders of this kind, there are known devices made of transparent glass or devices made of porcelain or glass impregnated with fine grains capable of effecting irregular reflection of rays of light and/or heat rays. However, measurement of rays of light transmitted through these burning cylinders of the prior art has revealed that, among rays of light of the so-called warm color like orange or red that visually give a person a feeling of warmth, are transmitted to the extent of only $\frac{1}{3}$ to $\frac{1}{4}$. Nevertheless, burning cylinders of the prior art cannot transmit $\frac{2}{3}$ to $\frac{3}{4}$ of these rays of light.

One object of the present invention is to provide a burning cylinder which is so deviced that light emitted by a heat source generates rays of light to be directly transmitted through a burning cylinder and rays of light to be transmitted through the burning cylinder after being generated from a reflected image formed by reflecting on the inner surface of the burning cylinder once or more than twice, thereby visualizing as if there are plural flames arising from one heat source, and at the same time the shady part is minimized due to light from many directions, thereby making a looker feel more warmth.

The foregoing object can be achieved by providing a burning cylinder wherein at least the inner surface of the base of the cylinder, which is so devised as to surround the heat source to constitute the shell of a burning chamber and formed of a transparent or translucent and highly heat-resisting material, is deposited with a very thin, highly transparent coating layer of metal or coating layer of metallic compound.

A further object of the present invention is to provide a burning cylinder which enables a looker to observe the reflected image formed in the burning cylinder from the surroundings in an enlarged size, thereby making him feel more warmth.

The foregoing object can be achieved by an embodiment of the invention wherein the cylinder is corrugated along the longitudinal direction.

Still further object of the present invention is to provide a burning cylinder which is characterized in that the base is composed of glass or porcelain, the coating layer of metal consists of Ti, Zr or Fe in the form of a simple substance or a mixture of these metals as deposited through vacuum evaporation onto the surface of the base, and the coating layer of metallic compound is formed by spraying a solution of a metal chloride on the surface of the base heated up to a temperature close to the softening point thereof.

The objects and characteristics described above and other characteristics will be self-explanatory when referred to the two embodiments illustrated by the appended drawings.

DETAILED DESCRIPTION OF THE INVENTION

Figure 1:
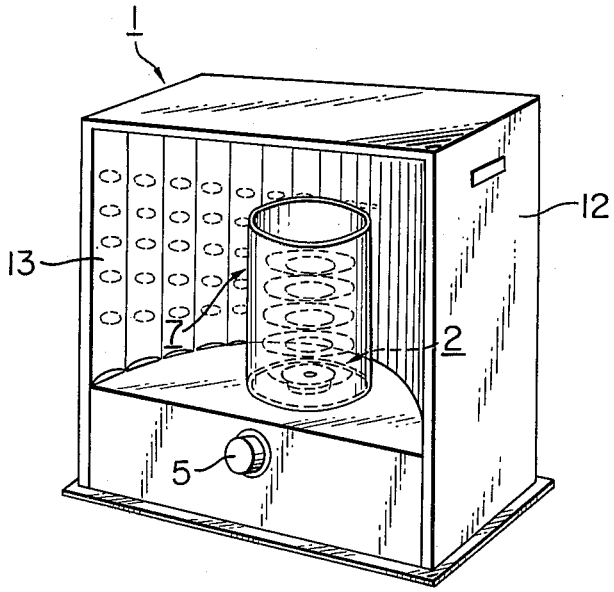
FIG. 1 is a perspective view of an oil stove equipped with a burning cylinder according to the present invention.
Figure 3:
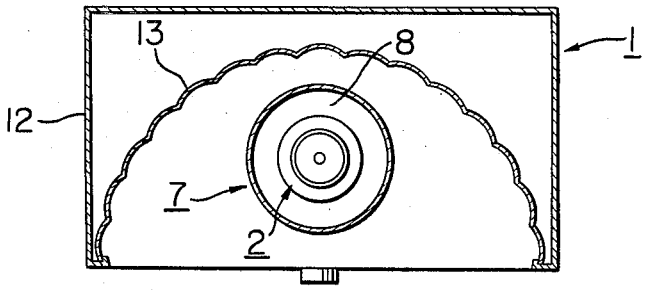
FIG. 3 is a drawing of the same stove as shown in FIG. 2 as cut along the line III—III and viewed in the direction of arrow.

FIGS. 1 through 4 illustrate an oil stove 1 employing the first embodiment of the present invention, and the reference numeral 2 therein denotes a burning apparatus of said stove. This burning apparatus 2 is equipped with a wick 3, a fuel tank 4 and a knob 5 for up-and-down wick like conventional stoves of this kind. 6 denotes the flames generated by the burning apparatus 2.

7 denotes a burning cylinder that surrounds the flames 6 and constitutes a burning chamber 8 above the burning apparatus 2. According to the present invention, the base 9 of the cylinder is composed of a heat-resisting, transparent or translucent material such as glass or ceramic and the like, and the inner and outer surfaces thereof are respectively covered with a very thin, highly transparent coating layer 10 and 11, said coating layer being a layer of metal or a layer of metallic compound consisting of such a metal as Ti, Zr, Fe, etc. in the form of a simple substance or a mixture thereof as deposited on said surfaces. In the case where the coating layers 10 and 11 are metallic layers, they are to be formed by evaporating a coating material by heating in a high-temperature vacuum in the same way as the conventional vacuum evaporation method to thereby depositing said material onto the surface of the base 9 in the form of a thin coating layer. And, in the case where the coating layers are of metallic compound, they may be formed by spraying a solution prepared by dissolving a metal chloride in water or some organic solvent on the surface of the base 9 heated up to a temperature close to the softening point and causing the thus sprayed metal chloride to decompose and get oxidized. These methods will bring about a very thin, say, 0.1 to 0.5 $\mu$ in thickness, and satisfactorily transparent coating layers 10 and 11.

12 denotes the frame of the stove 1. The inside of this frame is provided with a reflector 13 as disposed by leaving a required space. In the present embodiment, this reflector consists of a plurality of arc-shaped plates vertically placed side by side.

In the afore described stove, burning in whitish yellow flames is effected by the burning apparatus 2, and by the flames 6 there are generated heat rays and rays of light.

Figure 4:
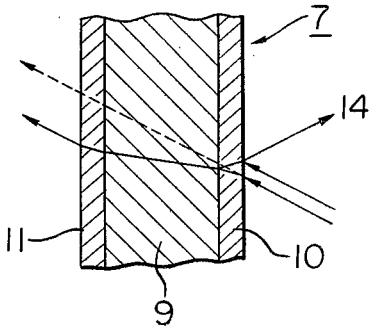
FIG. 4 is an enlarged sectional view of a part of the burning cylinder illustrated in the foregoing drawings, which explains the function of the burning cylinder.
Figure 2:
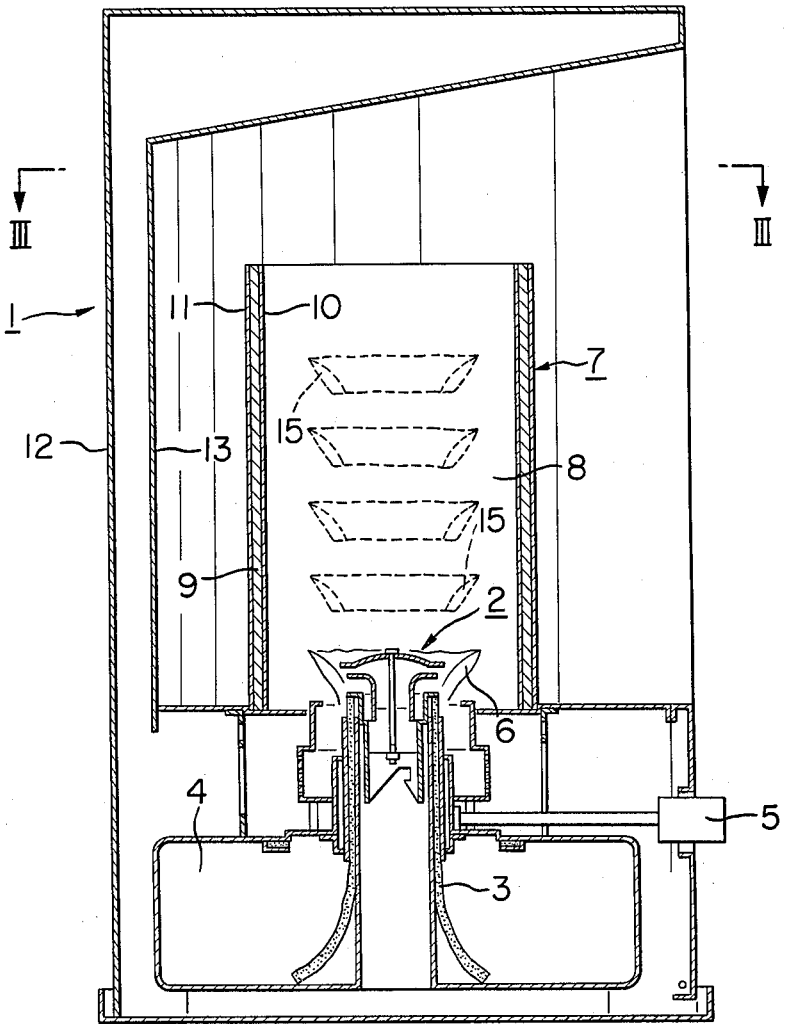
FIG. 2 is a longitudinal side view, on an enlarged scale, of the oil stove shown in FIG. 1.

Also, since the refractive index of the coating layer 10 per se is great, light pouring into the burning cylinder 7 at a small angle comes to have its incident angle toward the base 9 enlarged by virtue of the coating layer 10 as illustrated in FIG. 4. Moreover, because of the relation between this incident angle and the refractive index peculiar to the porcelain or glass constituting the base 9, the angle of light passing through the burning cylinder 7 is always close to a right angle, the apparent thickness of the burning cylinder 7 can be lessened, and the transmission distance of light is decreased.

Especially in the case of the burning cylinder 7 disposed to surround the flames 6, the incident angle of light is mostly small, but even in such a case, light is transmitted through the burning cylinder 7 at about a right angle.

Further, experiments have revealed that infrared rays having a wave-length of 5 $\mu$ or more are not easily transmitted through the base 9 due to reflection by the coating layers 10 and 11. But, inasmuch as the infrared red rays are not easily transmitted through the base 9 even when it is not provided with the coating layer 10, provision of this coating layer 10 does not cause any change in the influence of infrared rays, and there can be obtained a burning cylinder 7 having a superb heating efficiency.

Since this coating layer 10 is very thin, and the thickness thereof is not fixed and has some undulations, there occurs mutual interference of light reflected by the coating layer 10 and light reflected by the surface of the base 9 after passing through said layer 10 to cause lessening or enhancement of a specific wave-length, whereby the reflected image 15 of the flames 6 caused by the reflected rays 14 appears to be colored. Besides, as there occurs change in the lessening or enhancement of the wave-length with any change of the thickness of the coating layer 10, it is possible to bring out a variety of colors. Further, in the case where reflection is repeated twice, thrice and so on by the inside of the burning cylinder 7, there are obtained plural reflected images 15 of the flames 6 that assume a multiple aspect. Moreover, these images give an impression of rainbow-like flames having such colors as red, yellow, green, etc., so they look very pretty.

Further, occurrence of a multiplicity of reflected images 15 within the burning cylinder 7 as above means apparent presence of flames 6 in the same number as the reflected image. In other words, even in the case of the presence of a single flame 6, rays of light come to the eyes of a looker from many directions as if there are a multiplicity of heating and luminous elements, and accordingly shady parts are minimized and enhancement of the warming effect can be expected.

By virtue of the reflector 13 provided along the back and flank of the burning cylinder 7, unlike the conventional apparatuses having the effect of merely reflecting heat rays, a multiplicity of colored images of flame generated by the burning cylinder 7 are reflected and therefore luminant rainbow-colored flames are reflected in the whole of the reflector 13 to thereby present a very fine spectacle. Especially, in the case where the reflector 13 is composed of assembly of a multiplicity of plane or concave specular surfaces, each specular surface always reflects a number of reflected images of flame and accordingly the whole reflector 13 shines in rainbow color by virtue of the flames tinged with various colors ranging from red to violet, so that it also can give an impression to the user as an interior decoration in addition to the use as a heating stove.

The outside coating layer 11 is, as stated above, so devised that the inside can be seen through it and, at the same time, things existing outside can be reflected therein to be observed by the user. And, the looker is impressed with an aesthetic feeling through the contrast between the heat source image of the inside and the image of said outside things.

Figure 5:
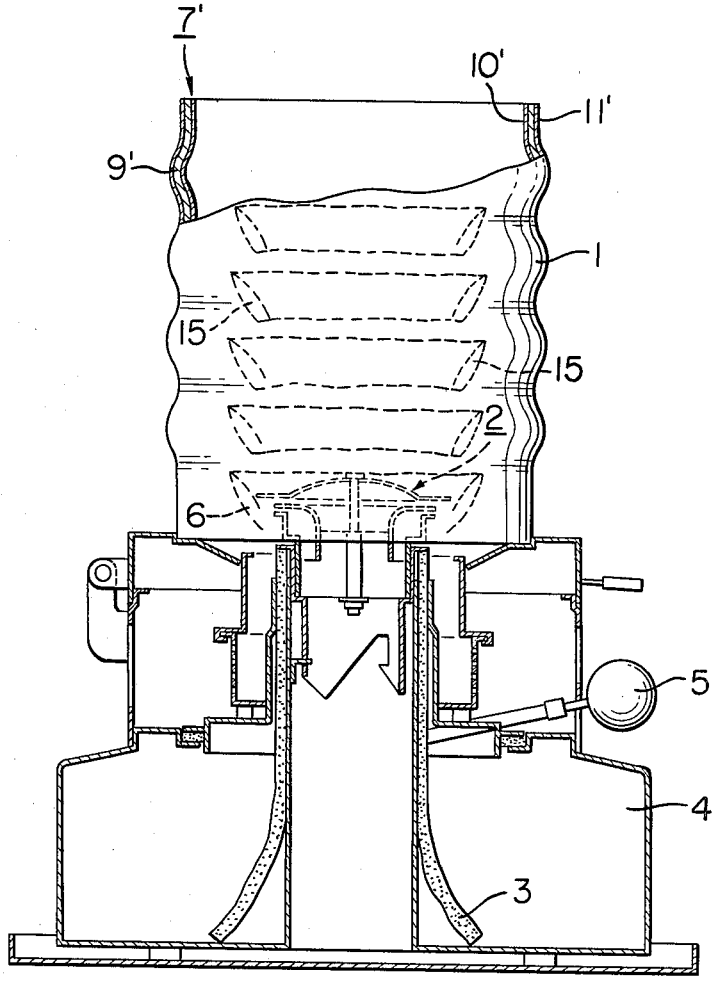
FIG. 5 is a longitudinal front view of a part of an oil stove equipped with a burning cylinder of a different configuration according to the present invention.

FIG. 5 illustrates the essential part of an oil stove employing the second embodiment of the present invention. The structure of this apparatus is the same as that of the apparatus illustrated by FIGS. 1 to 3 with the exception of the burning cylinder 7', so the identical parts of both apparatuses will be denoted by identical symbols to omit repeated explanation.

The difference between this second embodiment and the first embodiment lies in that the base 9' of the burning cylinder 7' and the coating layers 10' and 11' deposited thereon are corrugated along the longitudinal direction in their vertical section, and by virtue of the lens function of the ring-shaped undulatory portions of this corrugated structure, a multistage reflected image is magnified to look like a huge ring of flame, thereby causing a looker to feel furtherance of the warmth.

The afore described two embodiments show the cases wherein a burning cylinder according to the present invention is applied to an oil stove, respectively. However, it goes without saying that these burning cylinders are also applicable to gas stove, electric stove, etc., and in the case of applying it to an electric stove, a red-hot material is used as heat source in lieu of flames.

Although particular preferred embodiments of the invention have been disclosed in detail for illustrative purpose, it will be recognized that variations or modifications of the above disclosed apparatuses, including the arrangement of parts, lie within the scope of the present invention.

What is claimed is:

1. A heating apparatus having a decorative lighting effect comprising:

A source of heat which emits visible radiation;

a cylindrical tube of transparent or translucent and highly heat resistive material which is located about said source of heat and which extends a distance above said source of heat, at least the inner surface of said cylindrical tube being coated with a layer of metal or a metallic compound 0.1 microns–0.5 microns thick;

whereby the combination of said cylindrical tube and said source of heat, when viewed from above at an angle other than 90 degrees, presents a plurality of images of the source of heat, the images being of various colors and at different apparent locations above the source of heat.

2. A heating apparatus according to claim 1, wherein said cylindrical tube is composed of glass or porcelain.

3. A heating apparatus according to claim 1, wherein said layer of metal or a metallic compound consists of Ti, Zr or Fe in the form of a simple substance or a mixture of these metals.

4. A heating apparatus according to claim 1, wherein the cylindrical tube is corrugated in a manner such that the corrugations are perpendicular to the central axis of the tube.

5. A heating apparatus according to claim 4, wherein said cylindrical tube is composed of glass or porcelain.

6. A heating apparatus according to claim 4, wherein the coating layer of metal or a metallic compound consists of Ti, Zr or Fe in the form of a simple substance or a mixture of these metals.

* * * * *